United States Patent [19]

Forsberg

[11] Patent Number: 4,511,066

[45] Date of Patent: Apr. 16, 1985

[54] DEVICE USED IN CONNECTION WITH CONTAINERS FOR BULK MATERIAL

[76] Inventor: Lennart G. Forsberg, Hagagatan 24 C, S-665 00 Kil, Sweden

[21] Appl. No.: 355,723

[22] PCT Filed: Jul. 8, 1981

[86] PCT No.: PCT/SE81/00210

§ 371 Date: Feb. 25, 1982

§ 102(e) Date: Feb. 25, 1982

[87] PCT Pub. No.: WO82/00284

PCT Pub. Date: Feb. 4, 1982

[30] Foreign Application Priority Data

Jul. 21, 1980 [SE] Sweden ..... 8005279

[51] Int. Cl.[3] ..... B65G 33/20

[52] U.S. Cl. ..... 222/189; 222/233; 222/241; 198/671

[58] Field of Search ..... 222/189, 199–200, 222/233–236, 239, 241, 238, 243–248, 564, 408.5, 409; 198/671

[56] References Cited

U.S. PATENT DOCUMENTS

| | | | |
|---|---|---|---|
| 1,038,251 | 9/1912 | Wideman | 222/238 X |
| 1,566,746 | 12/1925 | Herman | 222/200 |
| 2,253,945 | 8/1941 | Starrett | 222/233 X |
| 2,631,969 | 3/1953 | Klueger | 222/233 X |
| 4,043,488 | 8/1977 | Halvorsen et al. | 222/234 X |

FOREIGN PATENT DOCUMENTS

| | | | |
|---|---|---|---|
| 2407992 | 8/1975 | Fed. Rep. of Germany . | |
| 330407 | 10/1935 | Italy | 222/238 |
| 387691 | 10/1973 | U.S.S.R. | 222/238 |

*Primary Examiner*—Charles A. Marmor

*Attorney, Agent, or Firm*—Murray, Whisenhunt & Ferguson

[57] ABSTRACT

Device in a container for bulk material including a main part with mainly vertical walls and a converging feed-out part. In the feed-out part (3) an upwards vault mantle (7) is placed, and the mantle having a large number of openings (9) distributed over its surface, the openings permitting bulk material to pass through. The vault mantle is arranged in such a way that it can carry out oscillating movements in the container, whereby tendencies of bridge building in the container may be avoided and at the same time it is secured that the bulk material will reach the feed-out opening (4) adjacent to the feed-out zone in loose form. The vault mantle may have different configurations, e.g. the form of a lying cylinder, half-cylinder, an upwards vault dome or the form of an upwards pointing cone. The vault bottom and specially when it has the form of a cone may also be provided with projecting parts, e.g. in form of a separate rotatable tube with feed-in openings for bulk material. The oscillating movements can consist of rotative movements around an axis or of axial movements or of combinations of both forms of movement.

2 Claims, 10 Drawing Figures

DEVICE USED IN CONNECTION WITH CONTAINERS FOR BULK MATERIAL

TECHNICAL FIELD

The present invention refers to a device used in connection with containers for bulk material such as chipped wood, pellets and similar material; said container including a main part with essentially vertical walls and a converging part for feeding out the material. The device has been developed principally in order to avoid the formation of obstructive bridges or vaults in the container and the device is suitable for containers with square formed or rectangular cross-section, and preferably with a converging part for feeding out the material. A further development of the device can, however, be used as a feeding out device and will in such a case consist of a modified so called tubular feed-out device. A further development of the device is specially adapted to large containers with circular cross-section.

PRESENT ART

Bulk material such as chipped wood, pellets and granulated material has a tendency to agglomerate in form of bridges or vaults in the inside of silos and other containers resulting in an irregular feed-out flow or complete stoppage of the feed-out. Fields of force are built in different formations within the bulk material and they are taken up in the lower parts of the container and specially in the zone of transition between the vertical walls of the container and the converging feed-out part of the container.

Different devices to counteract the building of such vaults are described in a large number of patents, e.g. the Swedish patent descriptions Nos. 352 051 and 390 627. These examples refer to devices in form of cones, which protrude upwards into the bulk material. These devices have, however, certain disadvantages in common. The moving parts of the devices are placed in the lower converging part of the container and can thus not considerably influence the building of vaults, which generally takes place in the transition zone of the container or hereabove. The Swedish patent description No. 394 190 shows a vibration device which is used for loosening the bulk material in the transition zone. This device has, however, the disadvantage that it is highly susceptible of wear and that maintenance- and repair-work is very difficult to carry out. The Swedish patent description No. 409 981 describes a device including a rotating shaft with wings which rotate within the bulk material. One disadvantage of this device is that there is a considerable risk for the rotating arrangement to get stuck. The device requires a huge torque in order to turn the shaft around, which involves considerable risks for the equipment to be damaged. The device is furthermore difficult to reach when it gets stuck and it does not give a reliable loose feeding of material to the feeding-out means in the bottom of the silo, which in this case is essentially flat.

So called tubular feeders are also well known. These devices are formed as a tube or as a drum with holes in its cylindrical surface. The tube is arranged to rotate continuously in a certain direction and a screw feeder is placed coaxially within the tube rotating in an opposite direction in relation to the rotation of the tube. This known device is a very helpful means to feed out bulk material from a container. The rotating movement of the tube requires, however, special transmissions and these transmissions increase the cost of the corresponding devices.

DESCRIPTION OF THE INVENTION

It is an object of the invention to eliminate the above mentioned problems, limitations and disadvantages connected with the use of devices which are known. It is a special object of the invention to offer a device which permits the distribution of the fields of force within the bulk material in the bulk material container thus breaking the tendencies to build vaults and thus permitting the material to reach the bottom of the container in a loose condition and easy to feed out.

Another purpose of the invention is to eliminate the disadvantages and limitations known with the previous so called tubular feeders.

It is another object of the invention to achieve a design, which combines strength and reliable functioning.

These and other objects can be achieved if the device according to the present invention is provided with an upwards vaulted mantle, which is placed in the feed-out part of the container. The mantle is provided with a considerable number of holes distributed over the surface of the mantle, said holes serving the purpose of permitting the passage of bulk material. The vaulted mantle is furthermore arranged in such way that it can carry out oscillating movements in the container. When it is the question of eliminating the tendency of the material to build vaults, the vaulted part of the mantle reaches up to the main part of the container and the feed-out part. The purpose is to warrant that in combination with the oscillating movement the material will reach the bottom of the container in a loose state for out-feeding. In those cases when the device does not have the primary purpose of eliminating the tendency to build vaults, thus when it is essentially the question of feeding-out material then the device can be placed totally within the feed-out part of the container.

In those cases when the device is used as a vault breaker the mantle will form an intermediate bottom in the container and the device can then be adapted not only to containers with a square-formed cross section but also to containers with a rectangular or a circular cross section. In the two first mentioned cases the vault breaking intermediate bottom may preferably be in form of a half-cylinder but it may also be cylindrical. In the last mentioned case the mantel may preferably be in form of one half of a spherical surface.

When it is the question of very large containers then the device according to the description above will have rather too large dimensions and in those cases an other embodiment may be preferable in order to achieve the combination of vault breaking and feeding-out. The device will in such a case consist of a rotatable double cone in the convergent feeding-out part of the container and a rotatable tube protruding through an opening in the upper cone into the transition zone between the main part of the container and the feed-out part of the container. The upper cone and the tube are provided with a large number of openings, which permit the bulk material to pass through. In the lower cone there is an opening to a feed-out screw.

The oscillating movements of the vaulted mantle are generally executed around an axis of rotation. The angular deplacement of the oscillating movement is normally rather small (not larger than ±about 20°) but it can in certain special cases such as in the embodiment with a vault part including a prutruding turnable tube reach 360°. The oscillating movement of the vaulted mantle may, however, also be carried out in an axial direction.

Further characteristics of the invention and advantages with the device according to the present invention will be apparent from the following description of some embodiments.

SHORT DESCRIPTION OF FIGURES

In the following description of preferred embodiments reference will be made to the enclosed figures.

Only the essential in order to understand the invention has been shown in the figures, whilst other details have been excluded in order to give emphasis to the essential.

DESCRIPTION OF PREFERRED EMBODIMENTS

Figure 1:
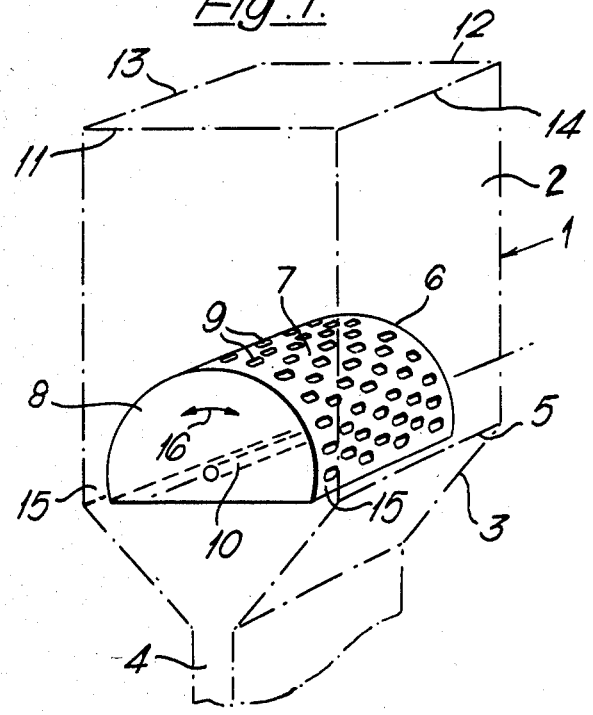
FIG. 1 shows the principles of the invention in a preferred embodiment of a vault breaker according to the present invention.

With reference first to FIG. 1 a container for bulk material has generally been designated with 1. The container 1 has straight vertical walls and a rectangular form in a horizontal section through the upper main part of the container, which has been designated with 2. A converging feed-out part of the container has been designated with 3 and the feed-out opening has been designated with 4. The transition zone between the main part 2 of the container and the converging feed-out part 3 has been designated with 5.

The vault intermedium bottom 6 is placed in the container 1. In the embodiment in question the vault intermedium bottom 6 has the form of a half-cylinder, which reaches the main part of the container 2 with its vault mantle departing from foot lines placed approximately in the transition zone 5 between the main part 1 of the container and the converging feed-out part 3. The vault mantle has been designated with 7 and its end, which is visible in FIG. 1, has been designated with 8. The mantle surface 7 is provided with a considerable number of openings 9 through which bulk material can pass. A shaft 10 connects the ends 6 and 8 of the device and said shaft is supported and has its bearings (not shown in FIG. 1) in both side walls of the container 1. The ends 6, 8 of the device are thus parallel with the walls 11 and 12 of the container and they are placed at a short distance from said walls.

The distance between the foot lines of the vault mantle surface 7 and the both remaining walls 13 and 14 of the container 1 is somewhat larger than said distance between ends 6, 8 and walls 11, 12, but the width of each passage, which has been designated with 15, does not exceed one tenth of the diameter of the intermedium bottom 6. The equipment also includes organs permitting to give the intermedium bottom 6 an oscillating movement around the shaft 10 and around the medium position shown in FIG. 1. The oscillating movement has been symbolized by means of the arrow 16. The means required to produce the movement have not been illustrated in FIG. 1.

The way of functioning of the device has schematically been described in FIG. 1. The way of functioning can be described as follows. The main part 2 of the container 1 is generally filled up with bulk material, e.g. chipped wood or pellets. The bulk material is supported by the intermedium bottom 6 and specifically its mantle surface 7. The device 6 oscillates around its shaft 10, thus promoting the flow of bulk material through the openings 9 in the mantle surface 7. Some material flows along the walls 13 and 14 and through the passages 15. The material quantity passing between the ends 8 and the walls 11 and 12 is on the other hand extremely small. Whilst the device oscillates within the bulk material volume in the main part 2 of the container in order to feed the bulk material in loose form towards the feed-out opening 4 any tendency towards an obtruding vault building in the container is eliminated. The deviation from the medium position of the oscillating movement can vary but it will generally be 10° to 30°.

Figure 2:
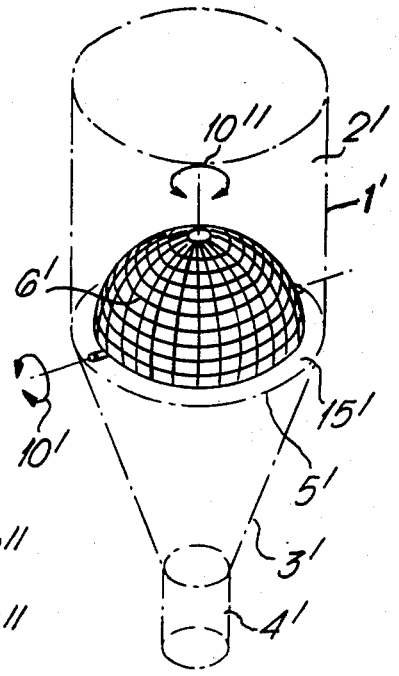
FIG. 2 shows a first alternative embodiment of the vault breaker according to the invention.

FIG. 2 shows a device according to the invention formed as a half-spherical dome 6' with its basis situated essentially at the same level as the transition 5' between the cylindrical part 2' and the conical part 3' of the container 1'. The dome 6' consists, in this embodiment, of a grating. The dome 6' can oscillate around a horizontal shaft 10' in the same way as in the previous embodiment and/or around a vertical shaft 10''. A ring-formed space between the dome 6' and the interior wall of the container 1' has been designated with 15'. The device functions in principle in the same way as in the previous embodiment in such a way that the bulk material flows through the grating of the dome 6' whilst the dome is oscillating and that the bulk material also flows through the space 15', thus avoiding the building of vaults in the main part 2' of the container, thus warranting that the bulk material will reach the feed-out duct 4' in loose condition.

Figure 3:
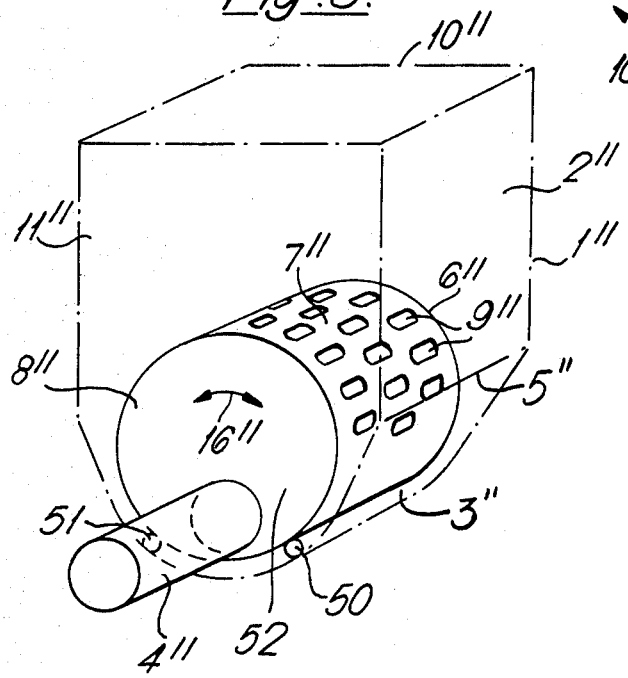
FIG. 3 shows a second alternative embodiment of the vault breaker according to the invention.

In the embodiment according to FIG. 3 a cylindrical drum 6'' is placed in the container 1''. The drum 6'' reaches up into the main part 2'' of the container and its centre line is situated somewhat below the transition zone 5'' between the main part 2'' of the container 1'' and the convergent feed-out zone 3''. The vault mantel surface has been designated 7'' and its visible end in FIG. 3 has been designated 8''. The mantel surface 7'' is provided with a large number of opening 9'' down to 20° below the centre line. The openings 9'' serve the purpose of letting bulk material pass through. The bottom of the drum and its ends are not provided with openings with the exception of a circular opening in the lowest part of the end 8'', this opening serves the purpose of feeding out bulk material. The ends 8'' of the device 6'' are thus parallel with the walls 10'' and 11'' of the container and are placed at a short distance from the walls 10'' and 11''. The drum 6'' is at its bottom supported by two supporting rollers 50 and 51 at each end. The equipment also includes organs intended to give the drum 6'' an oscillating movement around the medium position shown in FIG. 3. The oscillating movement has been symbolized with the arrow 16''. The organs required to achieve movement have not been shown in FIG. 3. The device also includes a transporting screw, not shown in FIG. 3 but positioned at 52.

The functioning of the device has schematically been described in FIG. 3 and said functioning corresponds in a general way to the functioning of the devices according to FIG. 1 and FIG. 2. The main part 2'' of the container 1'' is normally filled with bulk material, e.g. chipped wood or pellets. The bulk material rests on the upper part 7'' of the mantle surface of the cylindrical drum. The device 6'' oscillates around its centre thus promoting the flow of bulk material through the openings 9'' in the mantle surface 7''. The material accumulates in the bottom of the drum and is conveyed out of the container by means of the transportation screw 52. The device oscillates within the volume of bulk material in the main part 2'' thus feeding the bulk material in loose form and eliminating any tendency of vault building in the container. The deviation from the medium position of the oscillating movement can vary but it is normally ±about 10° to 30°.

Figure 4:
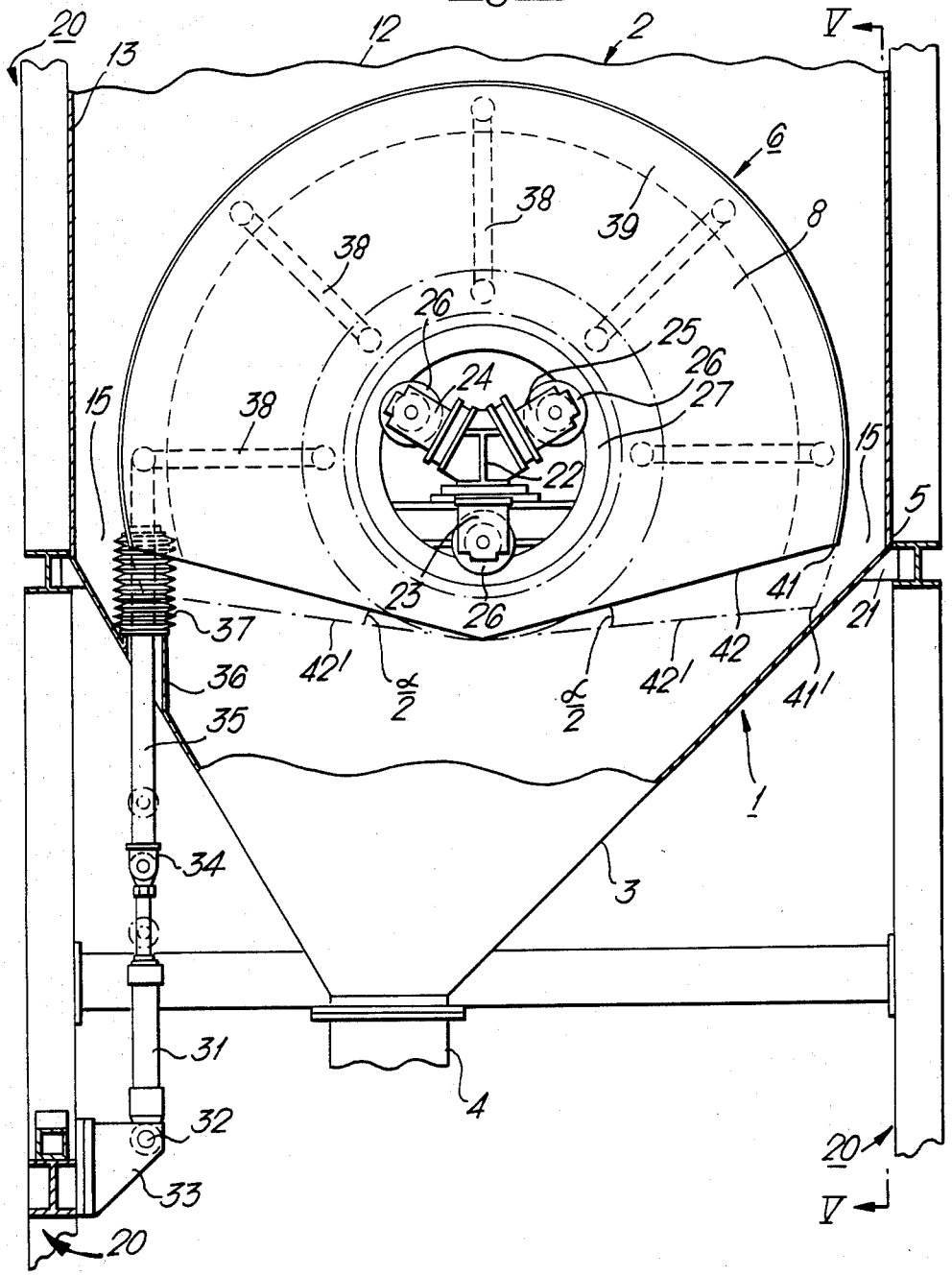
FIG. 4 shows a side view of a device according to the present invention corresponding to the embodiment shown schematically in FIG. 1.
Figure 5:
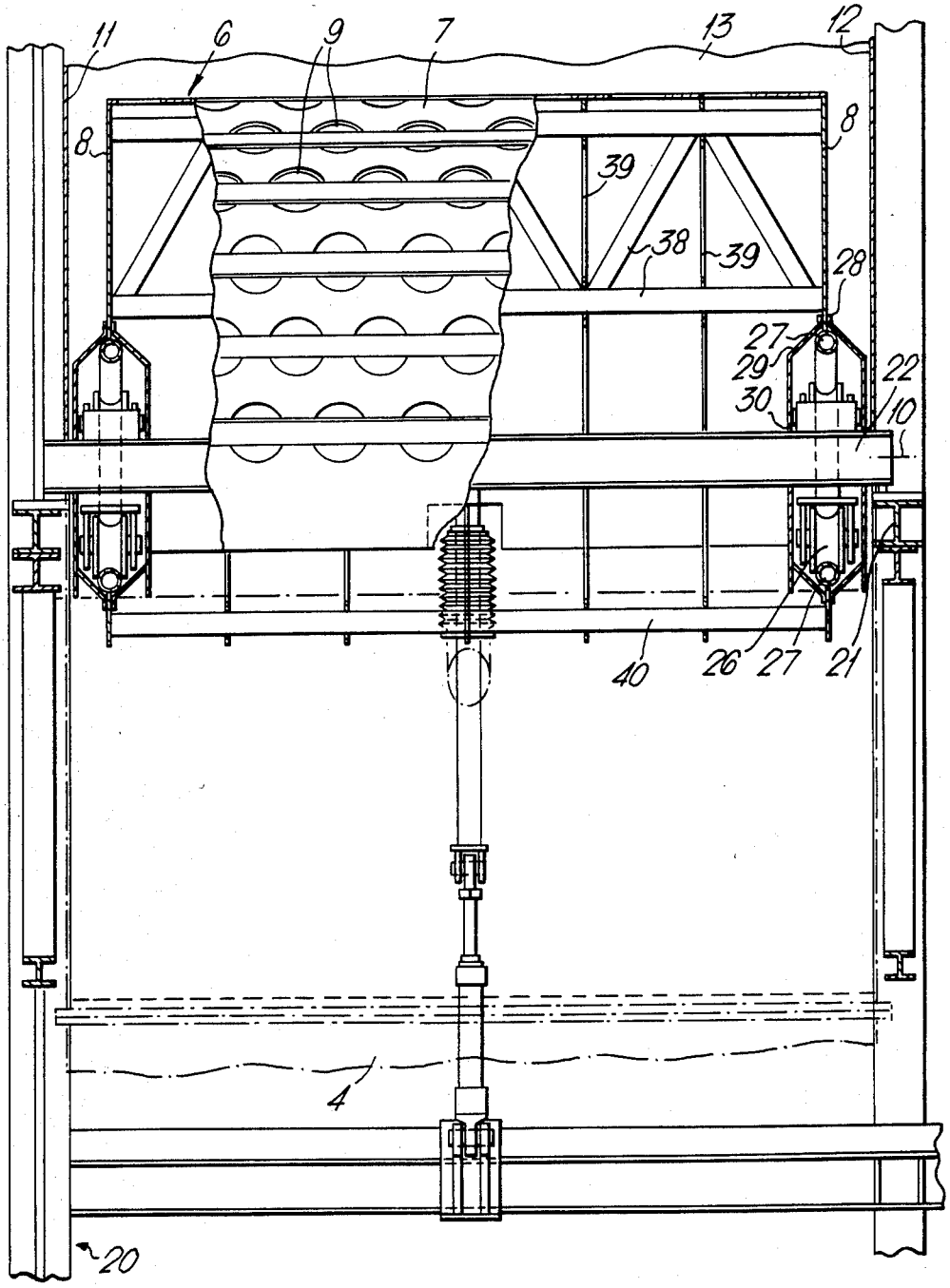
FIG. 5 shows a section V—V in FIG. 4.

The embodiment according to FIG. 1 shall now be described more in detail and referring to FIG. 4 and FIG. 5. The same designations have been used as in FIG. 1 for parts which have their correspondence in FIG. 1. The main purpose of FIG. 4 and FIG. 5 is to show how the device 6 is fitted into the container 1 and to show the organs for the oscillating movement. The figures also show how the container 1 is mounted in a structure of steel beams. The structure has in a general way been designated with 20. The structure will not be described in more detail in as much as it does not refer to the principles of the present invention.

A pair of horizontal, transversal steel beams belonging to the structure 20 has been designated 21. A transversal beam 22 rests upon these beams 21. The centre axis 10 coincides with the centre of this I-beam. There are three bearing boxes 23, 24 and 25 mounted on the beam 22. They are placed in the area of the end 8. The graduation between the bearing boxes is 120°. Each one of the bearing boxes 23 to 25 includes a wheel 26 arranged in such a way that it can roll against a ring 27 formed from a steel tube. The ring 27 is firmly fixed to a casing 29 and to the end 8 by means of an outer comb 28. The casing has an opening 30 in its central part for the beam 22 which permits the casing 29 to turn around the beam 22 without touching it.

There is a hydraulical cylinder 31 which gives the device 6 its oscillating movements. The lower part of the hydraulical cylinder 31 is fastened to the structure 20 by means of a console 33 and a link 32. The hydraulic cylinder 31 is connected with the vault intermedium bottom 6 by means of a linkage 34 and a bar 35. An inlet into the converging lower part 3 of the container 1 has been designated 36 and a tightening has been designated 37. More specifically, the hydraulic cylinder is connected to a framework generally designated 38, which is connected with the intermedium bottom 6 and serving the purpose of reforcing the intermedium bottom 6. The design of the framework 38 is shown on the figures. In order to furthermore stiffen the construction the framework 38 has been provided with a number of plates 39 in form of half-circular rings along the inside of the mantle 7. The casings 29 are furthermore interconnected in their lower parts by means of a beam 40.

The way of functioning of the device according to FIG. 4 and FIG. 5 follows the principles described referring to FIG. 1. The oscillating movement is achieved by means of the hydraulical cylinder 31, which moves the intermedium bottom 6 oscillating around the fixed beam 22. The rings 27 within the casings 29 will then roll against the wheels 26, which are supported by the beam 22 by means of the bearing boxes 23 to 25. The foot lines 41 and the lower extreme positions of the lower edges of the ends 8 have been designated respectively 41' and 42' in FIG. 3. The total rotating angle has been designated $\alpha$. It amounts to about 30° in the embodiment in question.

Figure 6:
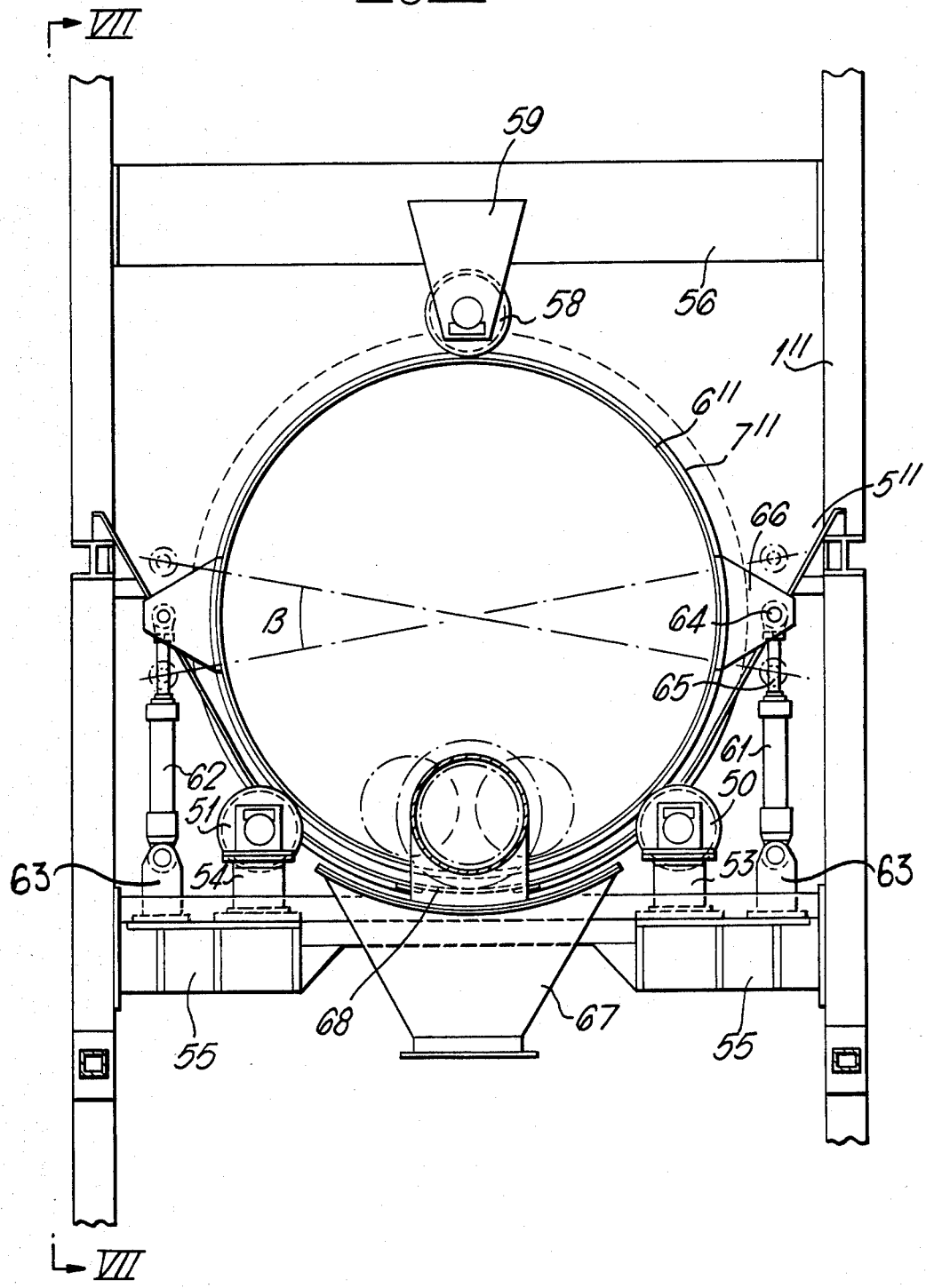
FIG. 6 shows a lateral view of a device according to the second alternative embodiment shown schematically in FIG. 3.
Figure 7:
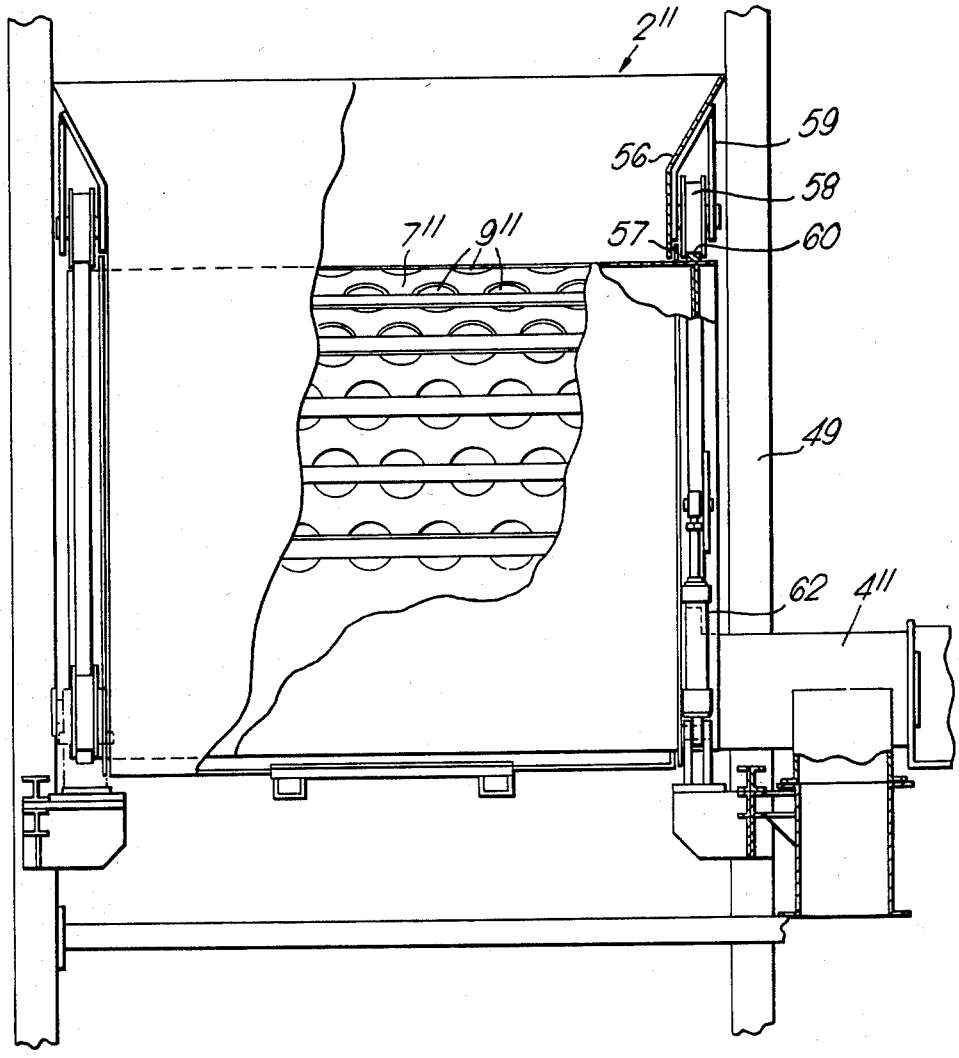
FIG. 7 shows a view VII—VII of FIG. 6, showing also a section of a part of the device.

The embodiment according to FIG. 3 is described in detail referring to the FIGS. 6 and 7. In FIG. 6 and FIG. 7 the same designations are used as in FIG. 3 for parts which have their correspondance in FIG. 3. FIGS. 6 and 7 show specially how the device 6'' is mounted in the container 1'' and they show furthermore organs to achieve the oscillating movement. The figures also show how the container 1'' is mounted on a structure of steel beams. The structure has the designation 49 and will not be described in detail. The drum 6'' is in its lower parts supported by two rollers 50 and 51, which are supported by the structure 49 and which are connected with a supporting beam construction 55 by means of rubber dampers 53 and 54. A guiding plate 56 is mounted in the main part 2'' of the container and a flange 57 prevents the bulk material to get into the area between the drum and the gables of the container. A guiding roller 58 is firmly supported by the guiding plate 56 by means of a welded sheet construction 59. The position of the drum within the container is determined by means of an on-welded guiding band 60, which follows the grooves of the supporting wheels and the guiding wheels.

There are two hydraulical cylinders 61 and 62 to achieve the oscillating movements of the device 6''. The lower part of each cylinder is fastened to the beam construction 55 by means of a linkage 63. The bar of the hydraulical cylinder 61 is connected to a triangular plate 66 welded on the drum 6'' by means of a linkage 64 and bar 65.

The transportation screw 52 is supported by the drum 6'' and will thus follow its movement. A clean-out door 68 is situated close to the feedout cone 67.

The way of functioning of the device described in FIG. 6 and FIG. 7 follows the principles described with reference to FIG. 3. The oscillating movement is achieved by means of the hydraulic cylinders 61 and 62, which give the drum 6'' the movement around its centre. The drum is supported by the two supporting rollers 50 and 51, which also keep the drum in position together with the guiding roller 58. The total rotating angle of the oscillating movement has been designated $\beta$. Said angle will reach a value of about 30° for the proposed embodiment.

The supporting and guiding means 50, 51 and 58 respectively as well as the movement generating hydraulical cylinders 61 and 62 are located outside the drum and are thus easy to reach for maintenance.

Further embodiments can be obtained combining the arrangements which have been described. As an example one embodiment can be mentioned in which the oscillating drum has holes or openings as previously described over its cylindrical surface and in its lower part a large hole in form of an elongated gap, through which the bulk material is fed out directly to a feed-out opening in accordance with FIG. 1. The drum in question is supported and guided by means of two supporting rollers and one guiding roller according to the embodiment shown in FIG. 3.

Figure 8:
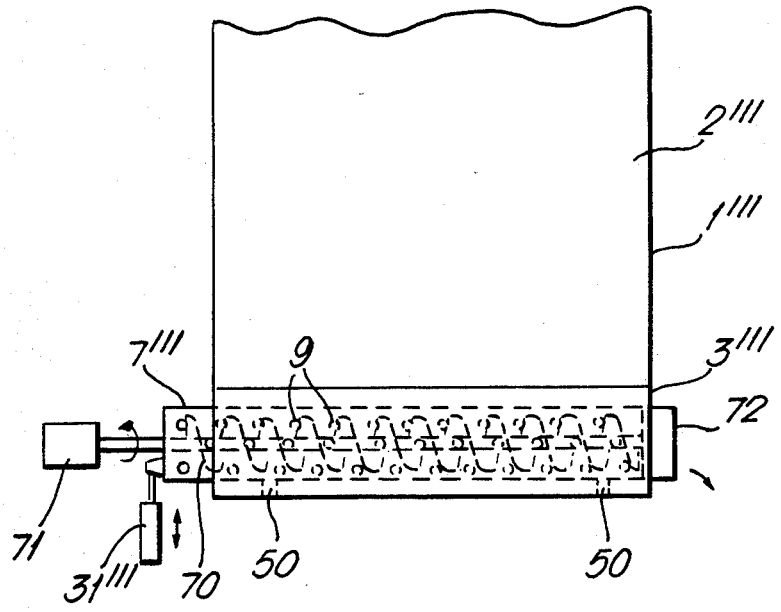
FIG. 8 shows how the principles of the invention can be used in connection with so called tube feeders.

In FIG. 8 an embodiment is shown, in which the principles of the invention are used together with so called tubular feeders. A tube 7''' is placed in the bottom part 3''' of a rectangular container 1'''. The main part of the container has been designated 2'''. The tube 7''' is supported by rollers 50 and the tube can be put into oscillating movement, i.e. reciprocating movements by means of the hydraulical cylinder 31'''. In the inside of the tube 7''' there is a feeding screw 70, which is arranged co-axially with the tube 7''' in such a way that it can rotate continuously driven by the driving motor 71. The tube 7''' is provided with holes 9, which permit the bulk material to pass through from the container 1''' into the interior of the tube 7'''. The bulk material passes through the openings 9 in the tube whilst the tube is under reciprocating motion and then the material is fed out through the feed-out opening 72 following a method which taken by itself is well known.

Figure 9:
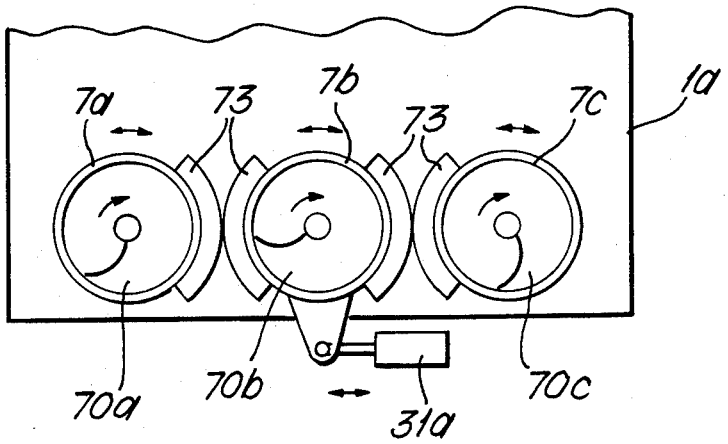
FIG. 9 shows another application of the invention in a schematical view of one end of the device.

In the embodiment according to FIG. 9 there are three tubular feeders arranged in parallel. The three feeders have been designated *7a*, *7b* and *7c*. The tubes *7a–7c* have been provided with holes for passing through of bulk material in the same way as for tube 7''' according to FIG. 8. In each tube there is a feeding screw respectively 70*a*, 70*b* and 70*c*. Then tubular feeders are placed close to the bottom of a container 1*a*. The screws 70*a*–70*c* are arranged in such a way that they can rotate continuously in the same direction moved by driving organs which have not been shown on the drawing. For the oscillating movements of the tubes *7a–7c* there is a hydraulical cylinder 31*a*, which puts the intermedium tube *7b* in oscillating motion, i.e. in reciprocating motion. This motion is transmitted to the two other tubes *7a* respectively *7c* by means of toothed segments 73. Other means of transmitting the oscillating movement may, however, be used.

Figure 10:
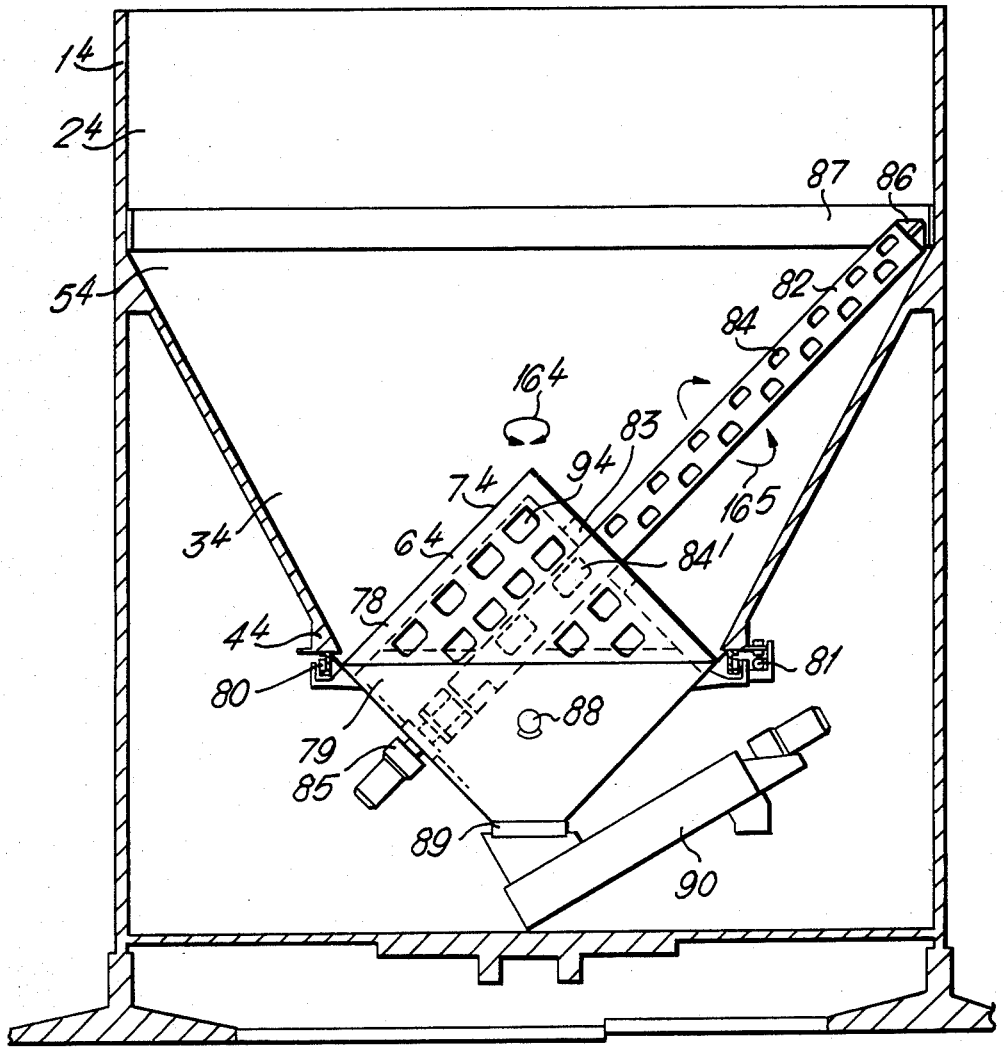
FIG. 10 shows a special embodiment for containers with circular cross section.

FIG. 10 shows a container $1^4$ with large dimensions built of e.g. concrete. The container has a circular cross section with a main part $2^4$ and a conical converging feed-out part $3^4$ with a large opening $4^4$. The transition between the main part $2^4$ and the feed-out part $3^4$ has been designated $5^4$. The arrangement for vault-breaking and feeding-out consists of an intermedium bottom $6^4$ in form of a double cone 78–79, and a tube 82 which reaches from the double cone up to the transition zone 54 of the container. The mantle surface $7^4$ of the upper cone 78 is provided with openings $9^4$ permitting the bulk material to pass through. The double cone 78–79 is supported by a circular rail 80, which consists of an U-beam in upend position. The double cone can be turned around and it is driven in stepwise motion by means of a driving arrangement 81, which is in itself known. The cone returns to its original position after a complete revolution. The receiprocating movement of the double cone has been symbolized in FIG. 10 by means of the arrow-symbol $16^4$. The tube 82 passes through an opening 83 in the upper cone 78 and reaches the transition zone $5^4$ of the container. The tube 82 has a large number of feed-out openings 84' in the inside of the cone. The tube is driven continuously either rotating or oscillating by means of a motor 85, which is placed outside the lower cone 79. The movement of the tube has been symbolized by arrows $16^5$. The upper part 86 of the tube is conical and the generatrix of the corresponding cone is parallel in relation to a wearing ring 87 in the inside of the container. The wearing ring consists of a steel band or a band of non-friction material. The lower part 79 of the double cone is provided with a level indicator 88 and a circular opening 89 towards the feed-out device 90. The way of functioning of the device according to FIG. 10 can be described as a combination of the movement $16^4$ of the cone and the movement $16^5$ of the tube with the purpose to prevent the building of vaults in the transition zone $5^4$ and to facilitate the feeding-out of the bulk material. The cone 78–79 is provided with a protection device, which stops the rotating movement of the cone if the resistance against the rotating movement is too high. The protection device in question is not a part of the invention in itself. The tube 82, however, continues its rotating movement $16^5$ around its axis thus removing material from the critical zone $5^4$, in which vault-building is initiated and thus making it possible to reduce the resistance which has arisen. The level indicator 88 can stop both movements in order to avoid an obstruction of the feed-out opening 89.

I claim:

1. In a device in a container for bulk material for chipped wood, pellets and similar material, said container including a main part with mainly rectangular walls, and a feed-out part for securing an even flow of material from the container, the improvement comprising a plurality of tubes arranged in parallel side by side relation in the main part of the container, said tubes having a number of openings distributed over their surfaces for permitting the passing through of bulk material, said tubes being arranged to carry the passing through of bulk material, means to provide reciprocating movements to said tubes in the container with the upper part of said tubes protruding into the main part of the container, a feeding screw arranged co-axially inside said at least one tube and means for rotating said screw within said tube.

2. Device according to claim 1, wherein each tube includes a said feeding screw, which is co-axial with the tube.

* * * * *